US011278103B2

(12) United States Patent
Chang

(10) Patent No.: US 11,278,103 B2
(45) **Date of Patent: *Mar. 22, 2022**

(54) BODY-CARRIED DEVICE WITH HEAT DISSIPATION SYSTEM

(71) Applicant: Hung-Yuan Chang, Taichung (TW)

(72) Inventor: Hung-Yuan Chang, Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 17/131,275

(22) Filed: Dec. 22, 2020

(65) Prior Publication Data

US 2021/0112950 A1 Apr. 22, 2021

Related U.S. Application Data

(62) Division of application No. 16/655,738, filed on Oct. 17, 2019, now Pat. No. 10,932,546.

(51) Int. Cl.
*A45F 3/12* (2006.01)
*A45F 3/04* (2006.01)

(52) U.S. Cl.
CPC ..... *A45F 3/04* (2013.01); *A45F 3/12* (2013.01); *A45F 2003/125* (2013.01)

(58) Field of Classification Search
CPC ..... A45F 3/04; A45F 3/12; A45F 2003/122; A45F 2003/125; A41D 13/0025
USPC ..... 224/676
See application file for complete search history.

(56) References Cited

U.S. PATENT DOCUMENTS

| | | | | |
|---|---|---|---|---|
| 8,001,794 | B2 * | 8/2011 | Windisch | A41D 13/0051 62/3.5 |
| 10,555,594 | B2 * | 2/2020 | Tai | A45F 3/04 |
| 10,932,546 | B1 * | 3/2021 | Chang | A45F 3/12 |
| 2008/0121674 | A1 * | 5/2008 | Yang | A45F 3/04 224/644 |
| 2019/0075912 | A1 * | 3/2019 | Squires | A45F 3/04 |
| 2019/0093929 | A1 * | 3/2019 | Ye | A45F 3/04 |
| 2019/0367172 | A1 * | 12/2019 | Carver | A43B 7/005 |
| 2019/0374012 | A1 * | 12/2019 | Chang | A45F 3/04 |

* cited by examiner

*Primary Examiner* — Adam J Waggenspack
(74) *Attorney, Agent, or Firm* — Birch, Stewart, Kolasch & Birch, LLP

(57) ABSTRACT

A body-carried device includes a receiving bag, two carrying straps, and a heat dissipation system on the backside of the receiving bag. The heat dissipation system has a pump and an airflow guide tube unit. When a user's lower back directly contacts and pushes the pump, the air in the pump is pushed into the main tube and branch tube of the airflow guide tube unit. Some of the air exits the body-carried device through the main tube while the remainder of the air enters the heat dissipation area of the receiving bag through the branch tube. When the user's lower back moves away from the pump, the pump is elastically restored in shape to draw ambient air through the airflow guide tube unit into the pump.

6 Claims, 9 Drawing Sheets

BODY-CARRIED DEVICE WITH HEAT DISSIPATION SYSTEM

CROSS-REFERENCE TO RELATED APPLICATION

This application is a divisional of application Ser. No. 16/655,738, filed on Oct. 17, 2019.

BACKGROUND OF THE INVENTION

1. Field of the Invention

The present invention relates to a device configured to be carried on a user's body. More particularly, the invention relates to a body-carried device with a heat dissipation system for effectively removing the moisture and sweat between the backside of the body-carried device and the user's body.

2. Description of the Related Art

Backpacks are designed to be carried on their users' back and hold the objects to be carried by the users so that the users' hands are free to do whatever is needed. This explains why backpacks are important to those who are out of doors such as hikers, travelers, mountaineers, and commuters. However, as a backpack user inevitably sweats while hiking, traveling, mountaineering, or commuting, the sweat tends to stay between the user's back and the backside of the backpack because of the limited space therebetween. If the aforesaid condition continues for a long time, the user's back will not only swelter, but also have an uncomfortably moist, sticky, and airless sensation.

To overcome the foregoing drawback, a breathable structure (e.g., a web-like or ridged structure) is additionally provided on the backside of a backpack, the objective being to reduce the area of contact, and make more room, between the user's back and the backside of the backpack to facilitate evaporation of the sweat on the user's back. While the breathable structure creates additional gaps between the user and the backpack, the gaps are poorly ventilated, making it impossible for the sweat and moisture in the gaps to evaporate effectively; as a result, the moist and sweltering sensation caused by the conventional backpacks remains.

SUMMARY OF THE INVENTION

The primary objective of the present invention is to provide a body-carried device that has a heat dissipation system. The heat dissipation system is configured to enhance air circulation between the body-carried device (e.g., a backpack or a baby carrier) and the one who is carrying the body-carried device on their body (hereinafter referred to as the user for short), thereby effectively removing the sweat or moisture left between the body-carried device and the user, allowing the user's body to stay dry and comfortable.

To achieve the primary objective stated above, the body-carried device of the present invention includes a receiving bag, two carrying straps, and the heat dissipation system. The receiving bag has a receiving space and a heat dissipation area. The heat dissipation area is located between the receiving space and the user and is provided with a vent hole. The carrying straps correspond to each other and are provided on the backside of the receiving bag. The heat dissipation system is provided in the heat dissipation area of the receiving bag and has a pump and an airflow guide tube unit. The pump is configured for direct contact with the user and has an output hole and an input hole. The airflow guide tube unit has an air outlet tube assembly and an air inlet tube assembly. The air outlet tube assembly has a main tube and a branch tube. One end of the main tube is provided at and communicates with the output hole of the pump, and the other end of the main tube extends through the vent hole of the heat dissipation area. One end of the branch tube stems from the main tube, and the other end of the branch tube is provided with an air outlet hole. The air inlet tube assembly has an open tube. One end of the open tube is provided at and communicates with the input hole of the pump, and the other end of the open tube is provided with an air inlet hole.

When the user's lower back (or abdomen) is in direct contact with and pushes the pump, the air in the pump is pushed into the main tube and the branch tube of the airflow guide tube unit. Some of the air flows out of the body-carried device through the main tube while the remaining portion of the air flows to the heat dissipation area through the branch tube. When the user's lower back (or abdomen) moves away from the pump, the pump returns to its original state due to the elasticity of the pump and thereby draws air from outside the body-carried device into the open tube of the airflow guide tube unit and hence into the pump. Thus, while the user is walking or moving otherwise, the moisture and sweat between the user and the body-carried device can be continually removed, allowing the user's body to stay dry and comfortable.

Preferably, the body-carried device with the heat dissipation system further includes a pouch, and the heat dissipation system is provided in the pouch. The pouch is composed essentially of a breathable pad and a lining. The breathable pad is detachably connected to the lining and is provided with the vent hole. The main tube of the air outlet tube assembly extends through the vent hole to communicate with the external environment and thereby enhance air circulation, allowing the moisture and sweat between the user and the body-carried device to be effectively removed.

Preferably, the breathable pad of the pouch is provided with an opening, and the pump is provided in the opening and exposed from the breathable pad, thereby allowing the user to be in direct contact with the pump and push the pump effectively to achieve efficient air circulation.

Preferably, the body-carried device with the heat dissipation system further includes a breathable cushioning element. The breathable cushioning element is provided between the breathable pad and the lining of the pouch to increase the comfortableness with which the user carries the body-carried device and to allow the air output from the branch tube to flow evenly between the breathable pad and the lining and thereby keep the interior of the pouch dry.

Preferably, the airflow guide tube unit further has a first one-way valve and a second one-way valve. The first one-way valve is mounted in the main tube of the air outlet tube assembly, and the second one-way valve is mounted in the open tube of the air inlet tube assembly, in order for ambient air to enter the pump only through the open tube of the air inlet tube assembly, and for the air in the pump to be output only through the main tube and the branch tube of the air outlet tube assembly. The goal is to enable proper air circulation, increase the efficiency of moisture removal, and prevent a mixed airflow.

Preferably, the airflow guide tube unit further has a filtration element. The filtration element is mounted on the open tube of the air inlet tube assembly, lest the air in the pump be too dirty or turbid.

Preferably, the backside of the receiving bag is provided with an upper-back portion, a lower-back portion, and an airflow channel between the upper-back portion and the lower-back portion. The airflow channel is concavely formed with respect to the upper-back portion and the lower-back portion. The vent hole of the heat dissipation area is located in the upper-back portion whereas the pump is located in the lower-back portion. Both the air outlet hole of the branch tube of the air outlet tube assembly and the air inlet hole of the open tube of the air inlet tube assembly are located in the upper-back portion of the receiving bag. The foregoing arrangements are intended to increase the space between the user and the body-carried device and enhance the heat dissipation efficiency and air circulation efficiency of the upper-back portion.

As an alternative, the backside of the receiving bag is preferably provided with an upper-abdomen portion and a lower-abdomen portion connected to and below the upper-abdomen portion. In that case, the vent hole of the heat dissipation area is located in the upper-abdomen portion, the pump is located in the lower-abdomen portion, and both the air outlet hole of the branch tube of the air outlet tube assembly and the air inlet hole of the open tube of the air inlet tube assembly are located in the upper-abdomen portion of the receiving bag to enhance the heat dissipation efficiency and air circulation efficiency of the upper-abdomen portion.

A detailed description of the structural details, technical features, assembly method, and use of the body-carried device with the heat dissipation system is given below. As a person of ordinary skill in the art would understand, the detailed description and the specific embodiments provided herein serve illustrative purposes only and are not intended to be restrictive of the scope of the invention.

DETAILED DESCRIPTION OF THE INVENTION

Figure 1:
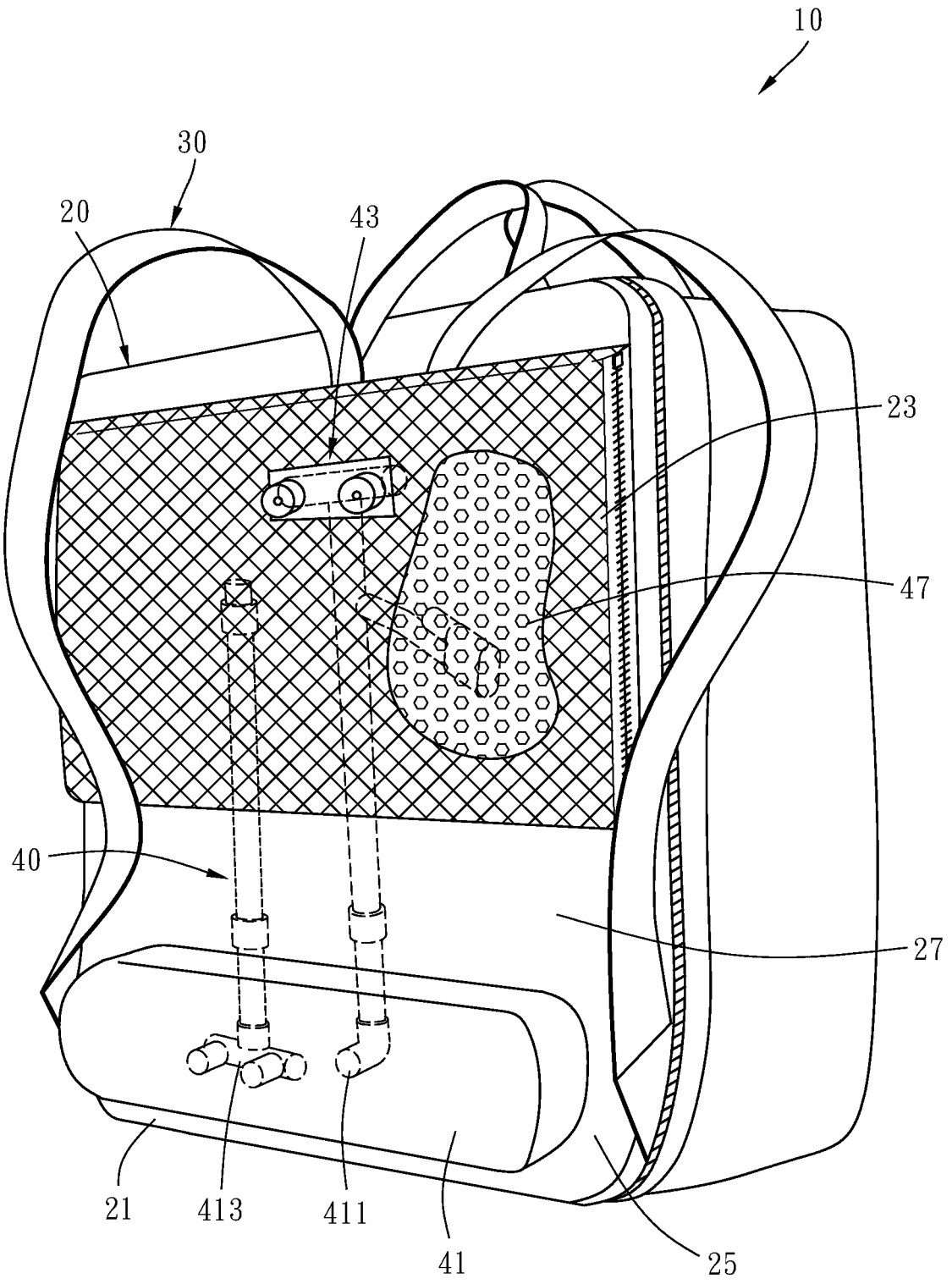
FIG. 1 is a perspective view of the body-carried device with a heat dissipation system according to the first preferred embodiment of the present invention.
Figure 2:
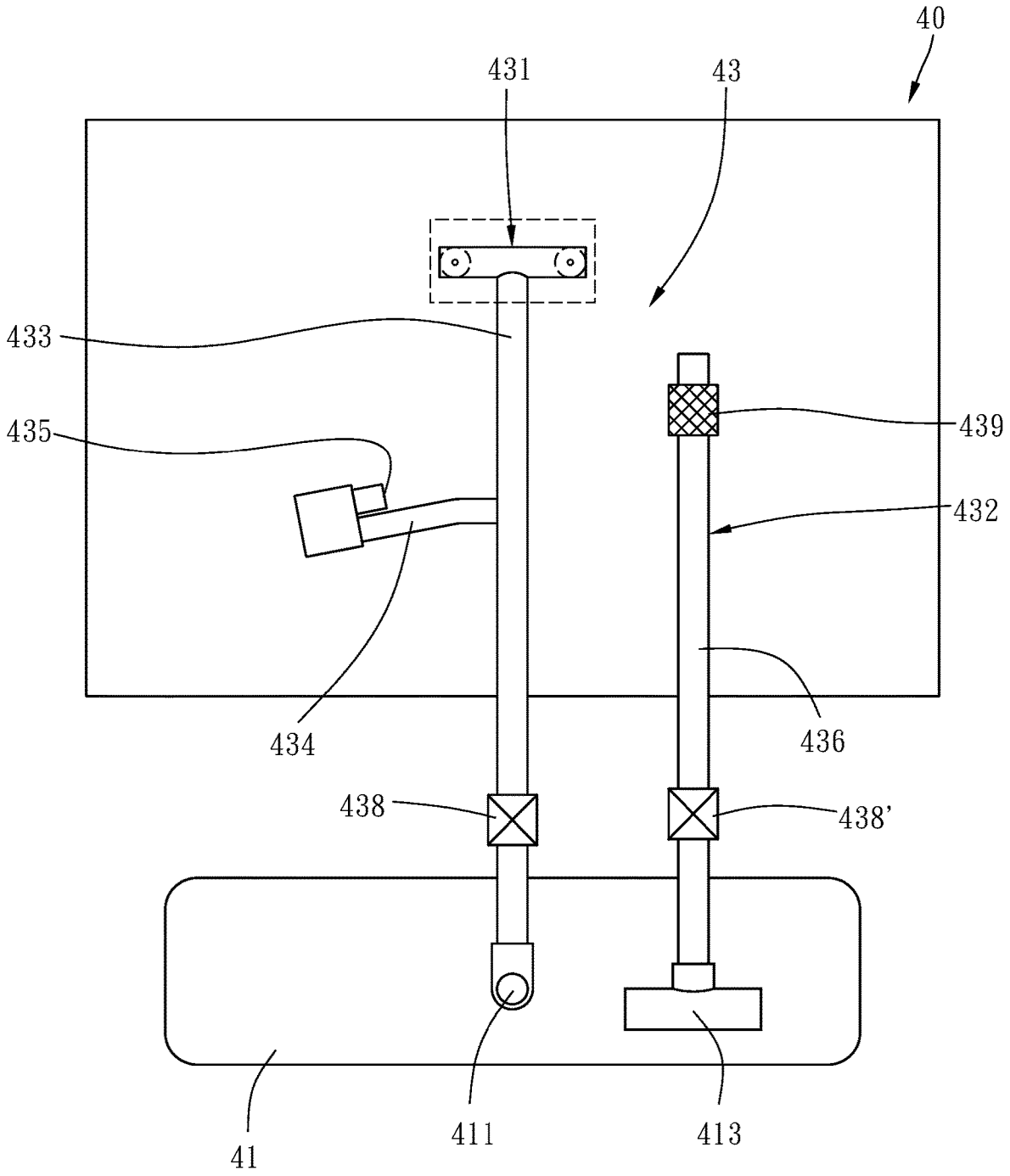
FIG. 2 is a rear view of the heat dissipation system in FIG. 1, showing in particular the air inlet tube assembly and the air outlet tube assembly of the airflow guide tube unit.
Figure 3:
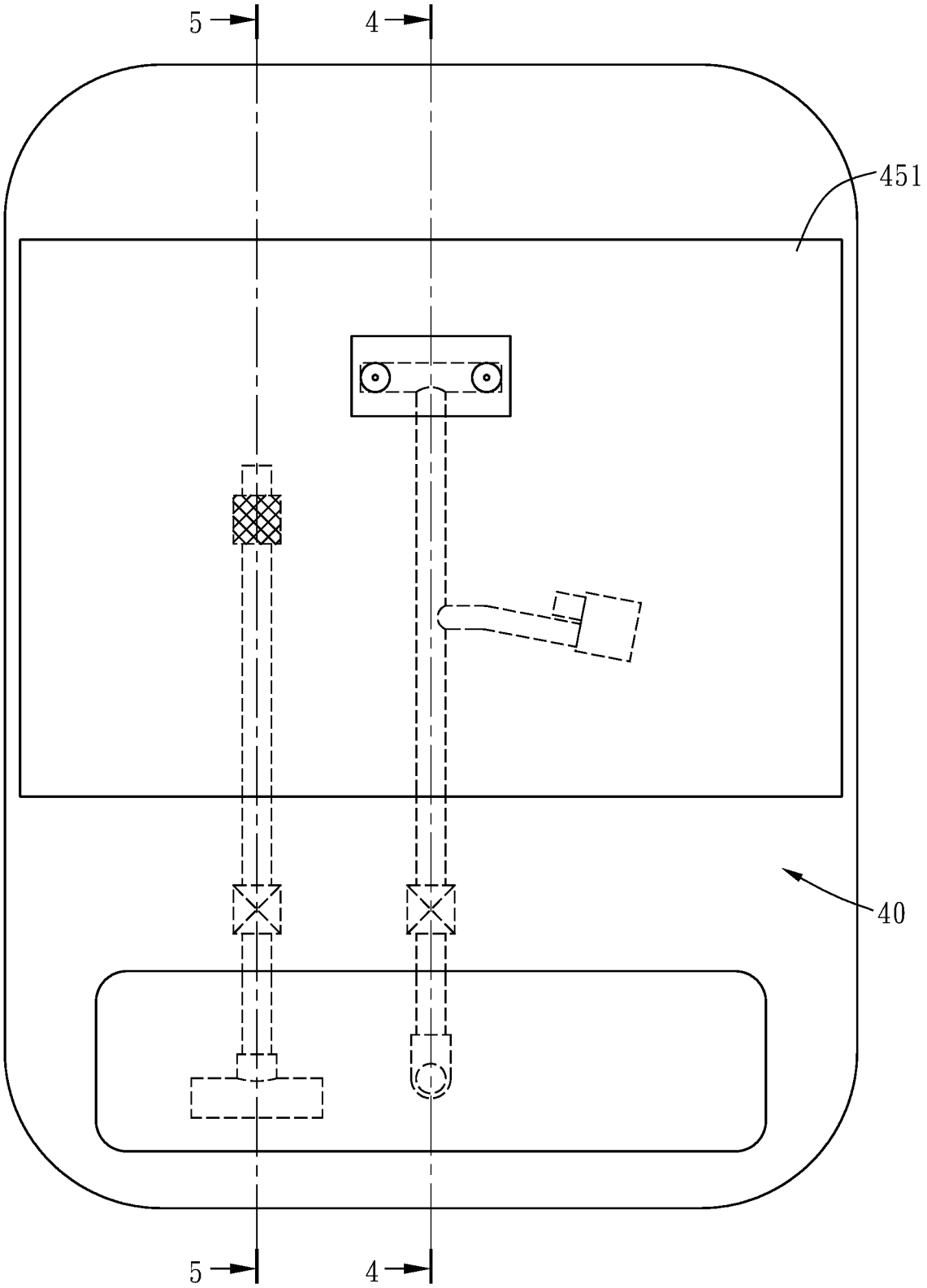
FIG. 3 is a front view of the heat dissipation system in FIG. 2, showing in particular the vent holes of the heat dissipation area.
Figure 4:
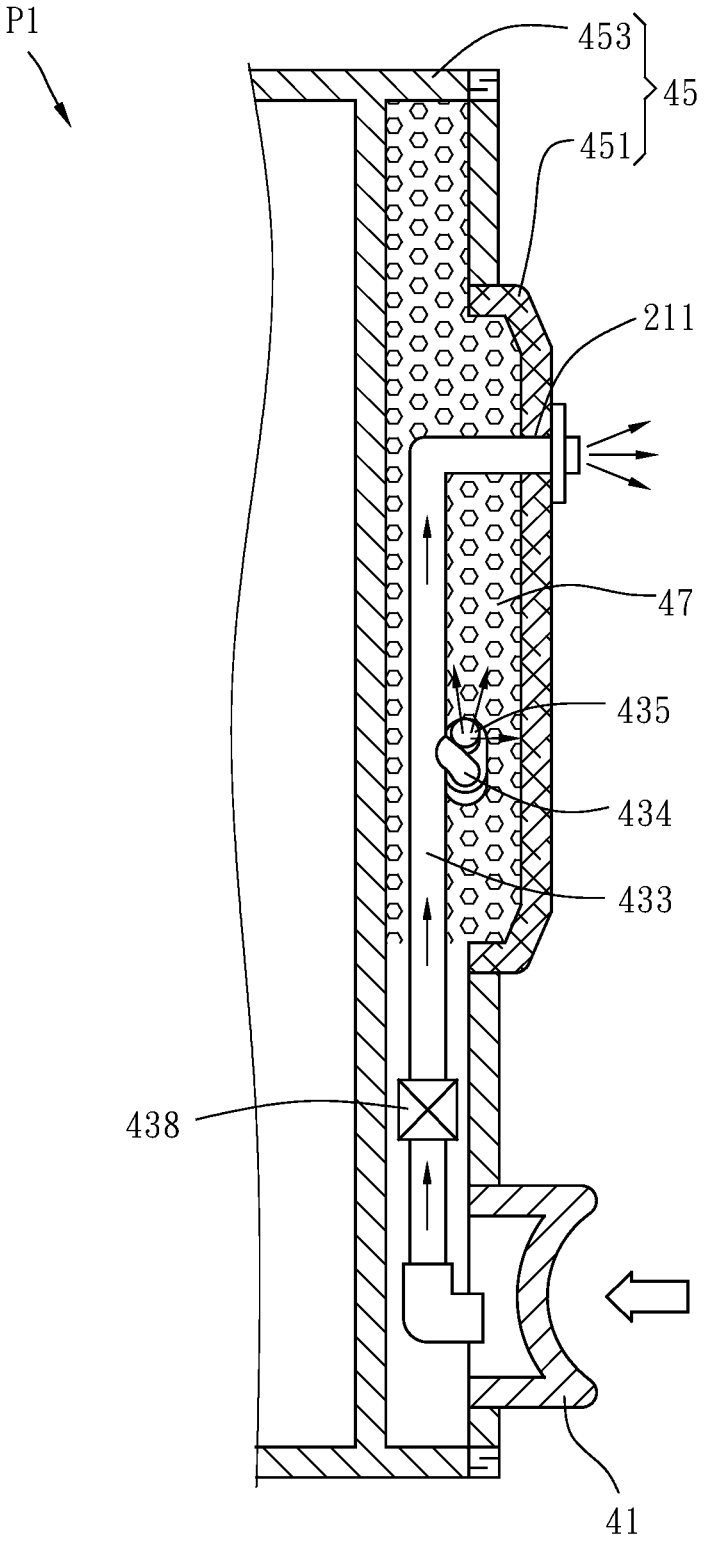
FIG. 4 is a sectional view taken along line 4-4 in FIG. 3, showing in particular the airflow taking place when the user's back is in the pushing state.
Figure 5:
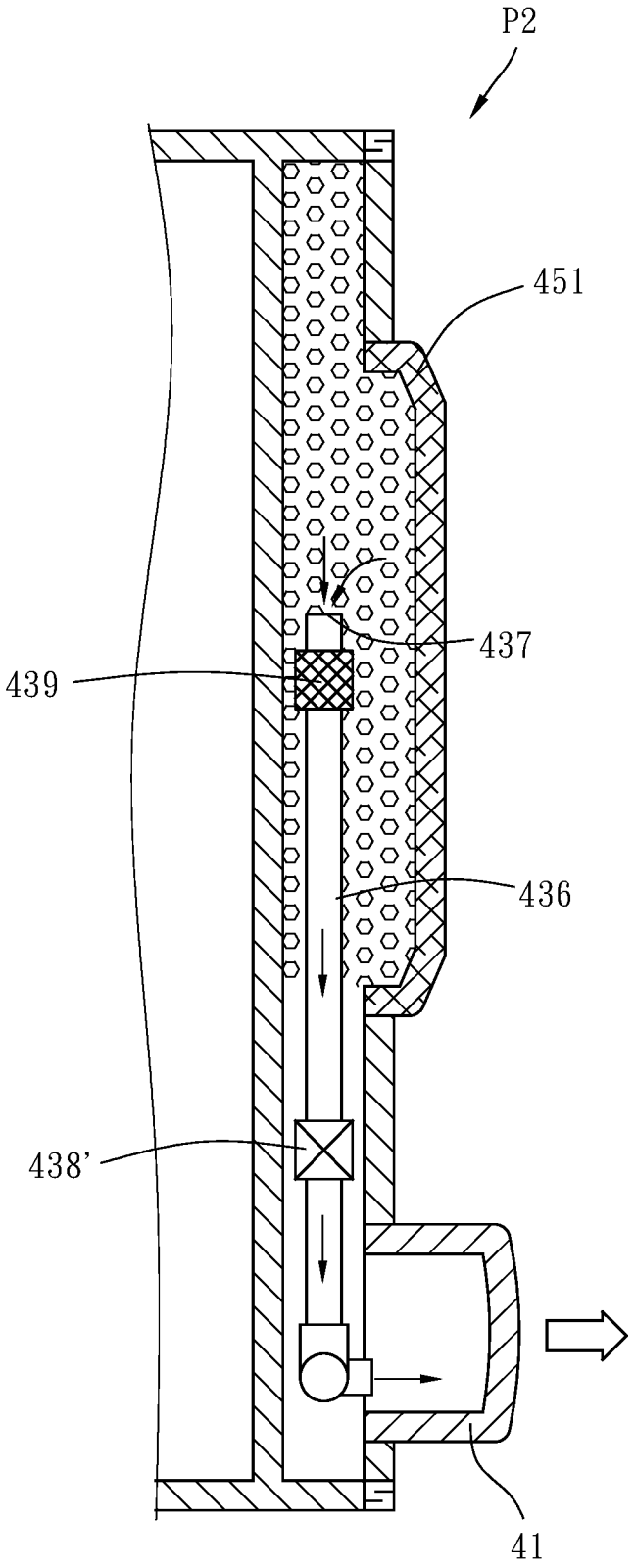
FIG. 5 is a sectional view taken along line 5-5 in FIG. 3, showing in particular the airflow taking place when the user's back is in the separated state.
Figure 6:
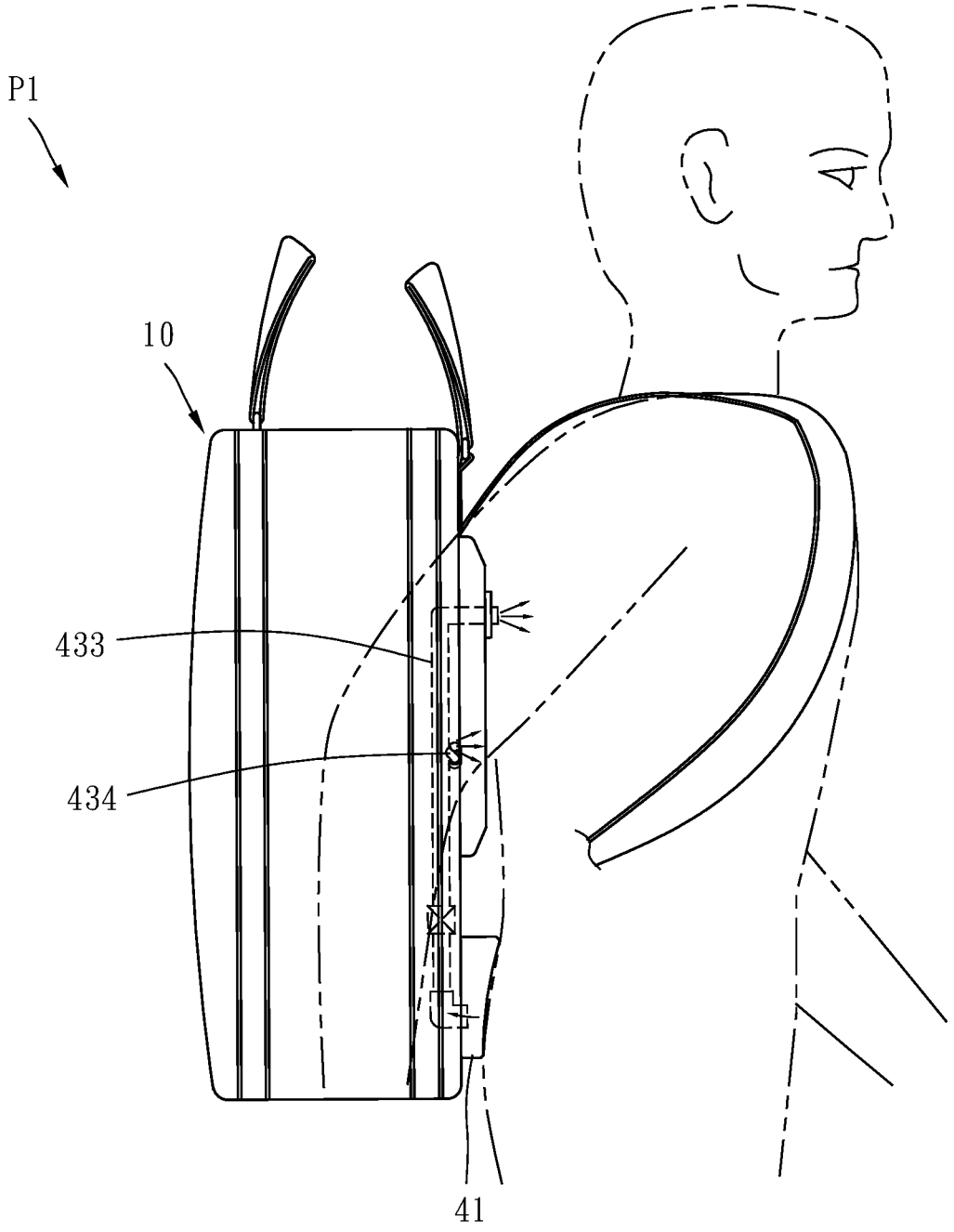
FIG. 6 and FIG. 7 schematically show the body-carried device in FIG. 1 carried on the user's body, with FIG. 6 showing the airflow taking place when the user's back is pushing the pump, and FIG. 7 showing the airflow taking place when the user's back is separated from the pump.
Figure 7:
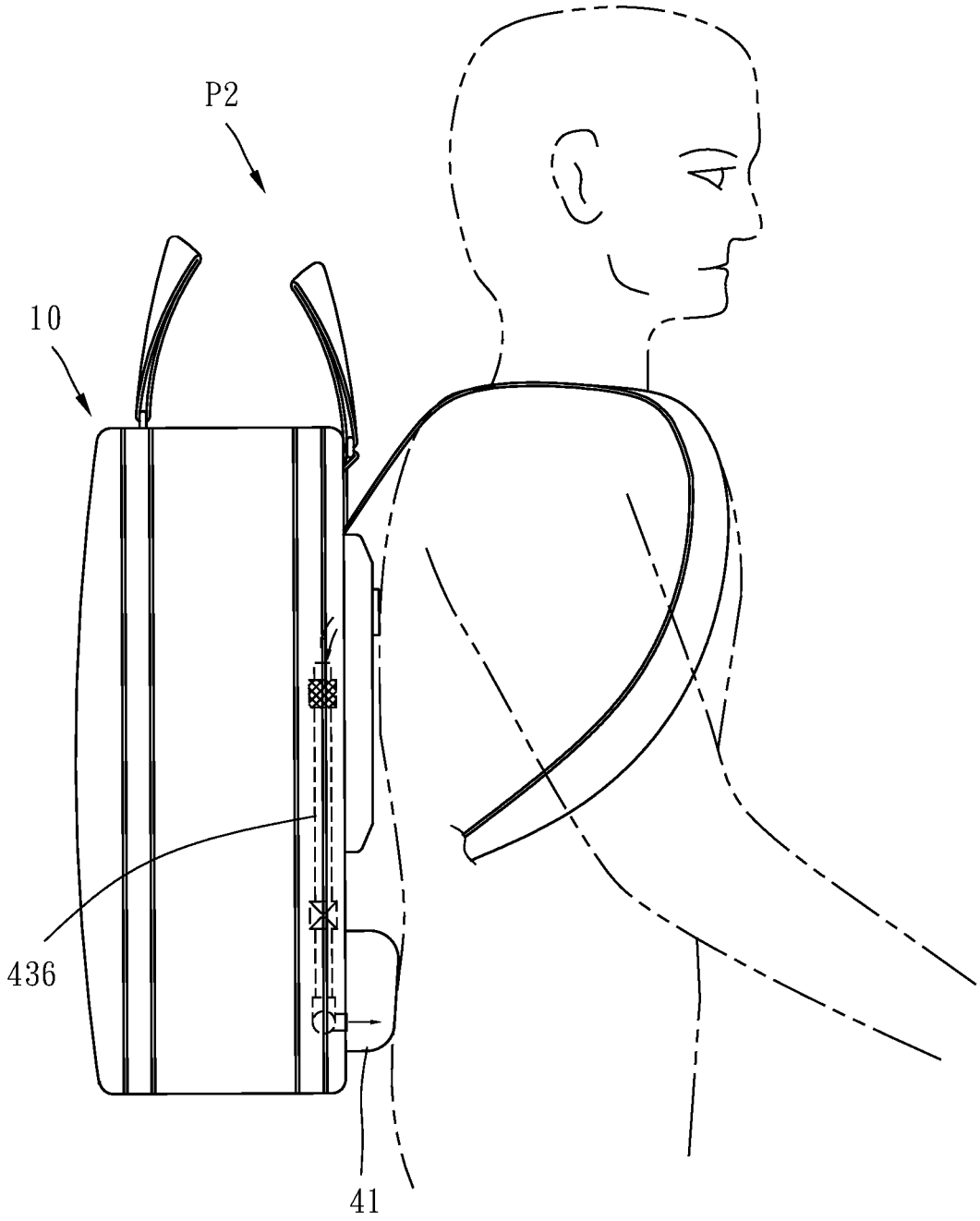

To begin with, the applicant wishes to point out that in the embodiments described below and the accompanying drawings, the same or similar elements or structural features are indicated by the same reference numeral.

Referring to FIG. 1 to FIG. 4 for the body-carried device 10 with a heat dissipation system according to the first preferred embodiment of the present invention, the body-carried device 10 is implemented as a backpack and includes a receiving bag 20, two carrying straps 30, and a heat dissipation system 40.

The receiving bag 20 has a receiving space (not shown in the drawings) and a heat dissipation area 21. The receiving space is configured to receive the objects placed therein. The heat dissipation area 21 is located between the receiving space and the person who is carrying the body-carried device 10 on their body (hereinafter referred to as the user for short). The heat dissipation area 21 is provided with two vent holes 211. The backside of the receiving bag 20 is provided with an upper-back portion 23, a lower-back portion 25, and an airflow channel 27. The airflow channel 27 lies between the upper-back portion 23 and the lower-back portion 25 and is concavely formed with respect to the upper-back portion 23 and the lower-back portion 25.

The carrying straps 30 correspond to each other, are provided on the backside of the receiving bag 20, and form two loops respectively. The user can extend each of their arms through the corresponding loop so that the carrying straps 30 go over the user's shoulders respectively.

The heat dissipation system 40 is provided in the heat dissipation area 21 of the receiving bag 20 and is configured for contact with the user's back. The heat dissipation system 40 has a pump 41 to be in direct contact with the user, an airflow guide tube unit 43, a pouch 45, and a breathable cushioning element 47.

The pump 41 is preferably made of an elastic material. It is understood that the pump 41 may be an electric pump. The pump 41 has an output hole 411 and two input holes 413.

The airflow guide tube unit 43 has an air outlet tube assembly 431 and an air inlet tube assembly 432. The air outlet tube assembly 431 has a main tube 433 and a branch tube 434 extending from the main tube 433. One end of the main tube 433 is provided at and in communication with the output hole 411 of the pump 41. The other end of the main tube 433 is inserted through the vent holes 211 of the heat dissipation area 21. One end of the branch tube 434 stems from the main tube 433. The other end of the branch tube 434 is provided with an air outlet hole 435. The air inlet tube assembly 432 has an open tube 436. One end of the open tube 436 is provided at and in communication with the input holes 413 of the pump 41. The other end of the open tube 436 is provided with an air inlet hole 437.

The pouch 45 is composed essentially of a breathable pad 451 and a lining 453, wherein the lining 453 is located outside, and fixedly connected to, the receiving bag 20. It is understood that the lining 453 of the pouch 45 may be provided outside the receiving bag 20 by a joining or adhesive means or through a zipper (not shown). The heat dissipation system 40 is provided in the pouch 45. More specifically, the breathable cushioning element 47 is located between the breathable pad 451 and the lining 453 so that not only can the user carry the body-carried device 10 comfortably, but also the air flowing out of the branch tube 434 can flow evenly between the breathable pad 451 and the lining 453 to keep the interior of the pouch 45 dry. The breathable pad 451 is detachably connected to the lining 453 (e.g., through a zipper) and therefore can be detached for cleaning. The breathable pad 451 has the two vent holes 211. The main tube 433 of the air outlet tube assembly 431 extends through the breathable cushioning element 47 and is mounted to the vent holes 211 so as to communicate directly with the external environment, thereby enhancing air circulation to enable effective removal of the moisture and sweat between the user and the backpack. It is worth mentioning that the breathable pad 451 of the pouch 45 is provided with an opening 455, and that the pump 41 is located in the opening 455, exposed from the breathable pad 451, and therefore ready for direct contact with, and to be effectively squeezed by, the user to achieve efficient air circulation.

To prevent a mixed airflow, the airflow guide tube unit 43 further has a first one-way valve 438 and a second one-way valve 438'. The first one-way valve 438 is mounted in the main tube 433 of the air outlet tube assembly 431, and the second one-way valve 438' is mounted in the open tube 436 of the air inlet tube assembly 432. The one-way valves are so configured that ambient air can be input into the pump 41 only through the open tube 436 of the air inlet tube assembly 432, and that the air in the pump 41 can be output only through the main tube 433 and the branch tube 434 (or more particularly its air outlet hole 435) of the air outlet tube assembly 431. The foregoing design aims to achieve proper air circulation and efficient moisture removal. To prevent the air in the pump 41 from being too dirty or turbid, the airflow guide tube unit 43 further has a filtration element 439. The filtration element 439 is mounted on the open tube 436 of the air inlet tube assembly 432 so that air cannot flow into the pump 41 without being filtered by the filtration element 439 first.

In terms of use, referring to FIG. 2 and FIG. 4 to FIG. 7, the user's back alternates between a pushing state P1 and a separated state P2 with respect to the heat dissipation system 40 while the user is walking with the body-carried device 10 carried on their body. When in the pushing state P1, the user's lower back squeezes the pump 41 such that the air in the pump 41 is pushed, enters only the main tube 433 of the airflow guide tube unit 43 under the limitation of the second one-way valve 438', and eventually flows out of the main tube 433 and the branch tube 434. More specifically, some of the air is directly discharged outward of the breathable pad 451 through the main tube 433 to dissipate heat, and remove moisture, from the user's back, and the remaining portion of the air is discharged through the branch tube 434 into the space between the breathable pad 451 and the lining 453 to increase the airflow in the pouch 45, thereby encouraging the sweat and moisture on and in the breathable pad 451 to evaporate. When in the separated state P2, the user's lower back moves away from the pump 41 temporarily, so the pump 41 resumes its original state due to the elasticity of the pump 41. Consequently, ambient air as well as the hot, humid air in the breathable pad 451 is drawn into the air inlet hole 437 of the open tube 436 of the airflow guide tube unit 43 under the limitation of the first one-way valve 438 and is filtered by the filtration element 439 before entering the pump 41 to complete a ventilation cycle. Thus, while the user is walking or moving otherwise, the heat dissipation system 40 of the backpack 10 carried on the user's body will work incessantly to remove the moisture and sweat on the user's back and the backside of the backpack, thereby allowing the user's body to stay dry and comfortable.

Figure 8:
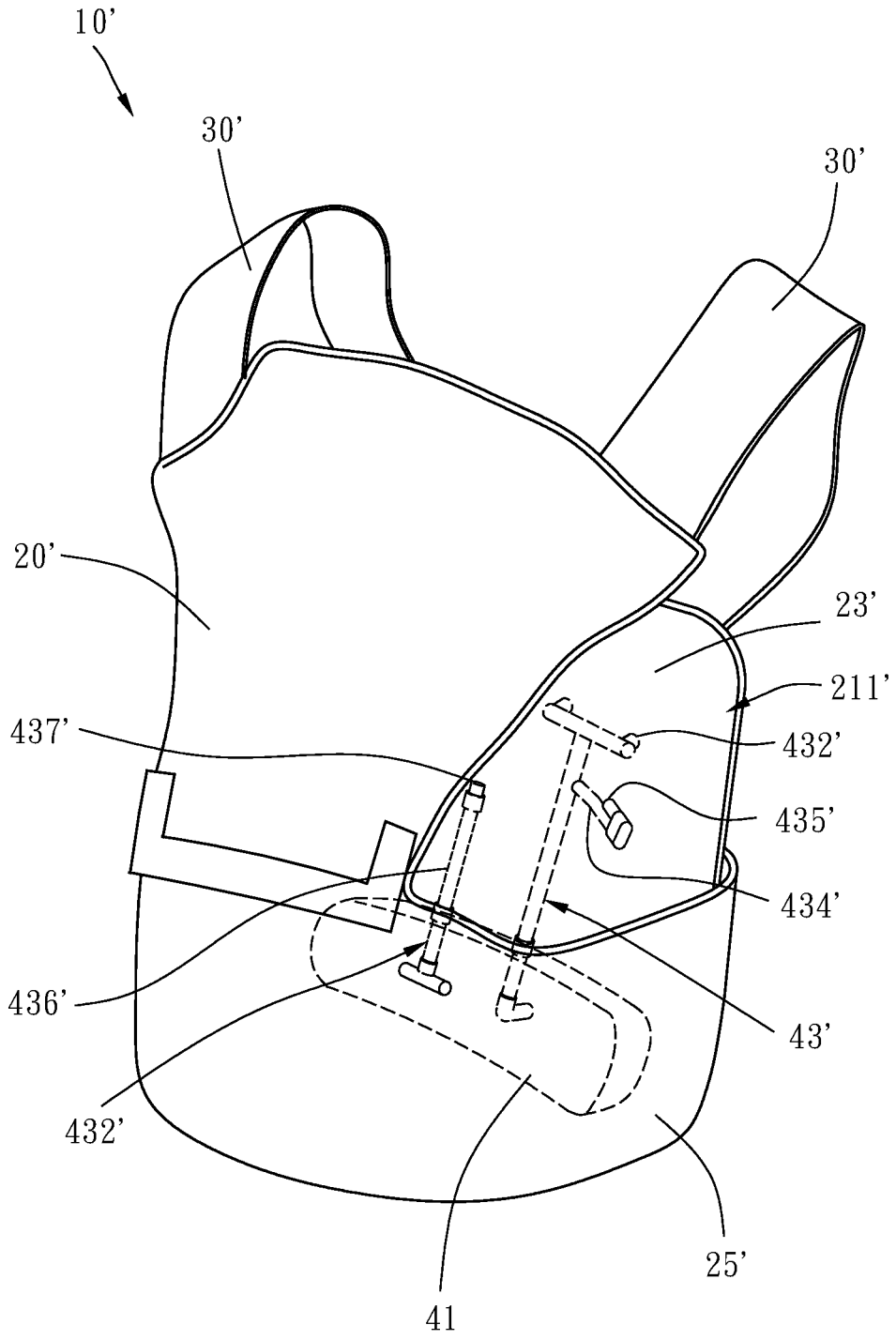
FIG. 8 is a perspective view of the body-carried device with a heat dissipation system according to the second preferred embodiment of the invention.
Figure 9:
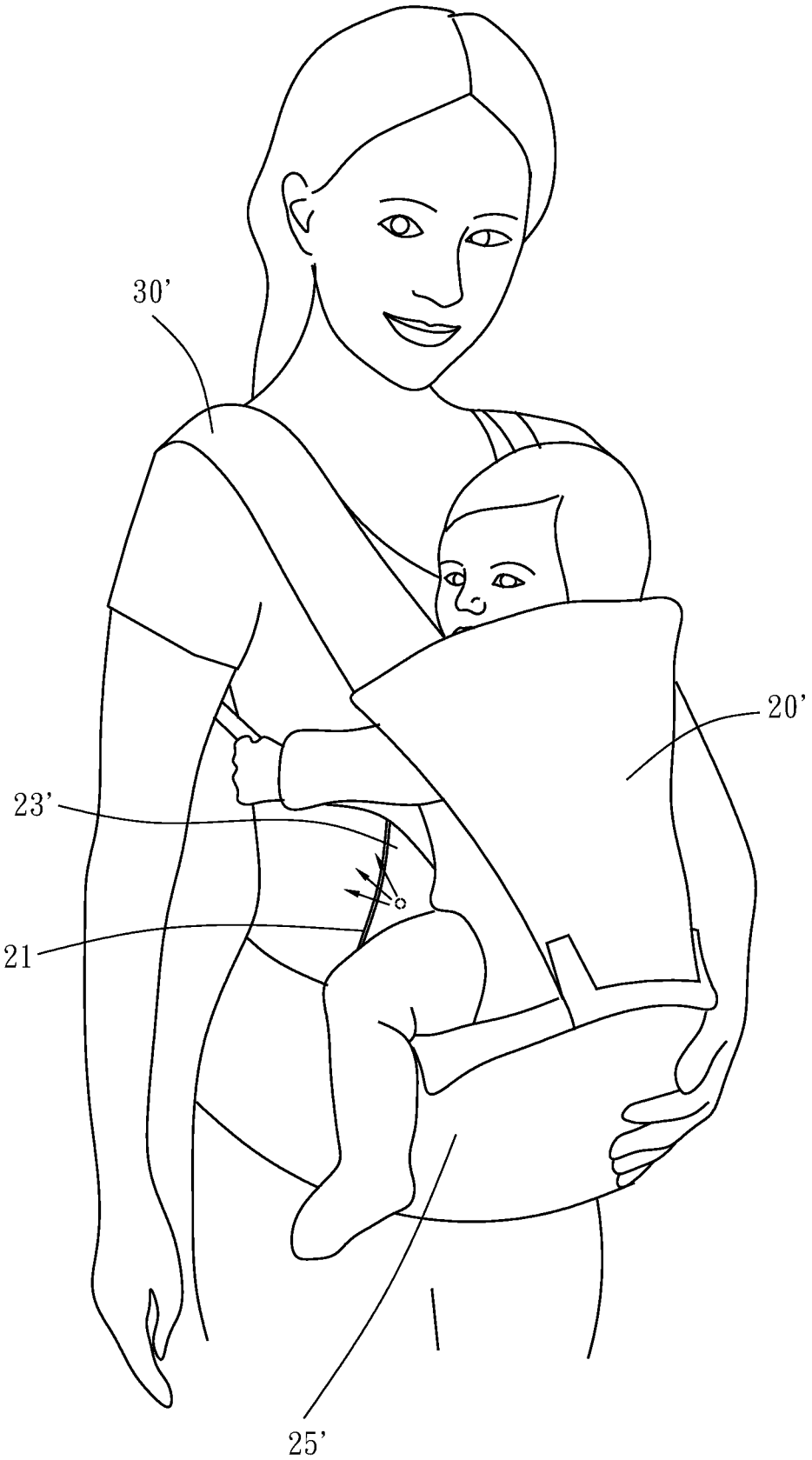
FIG. 9 schematically shows a state of use of, and the corresponding airflow from, the body-carried device in FIG. 8.

FIG. 8 and FIG. 9 show the body-carried device 10' with a heat dissipation system according to the second preferred embodiment of the present invention. The body-carried device 10' is implemented as a baby carrier and includes a receiving bag 20' for holding a baby, two carrying straps 30', and a heat dissipation system 40'. The backside of the receiving bag 20' is provided with an upper-abdomen portion 23' and a lower-abdomen portion 25' connected to and below the upper-abdomen portion 23'. The vent holes 211' of the heat dissipation area 21' of the receiving bag 20' are located in the upper-abdomen portion 23'. The pump 41 is located in the lower-abdomen portion 25'. Both the air outlet hole 435' of the branch tube 434' of the air outlet tube assembly 431' and the air inlet hole 437' of the open tube 436' of the air inlet tube assembly 432' are located in the upper-abdomen portion 23' of the receiving bag 20' to enhance the heat dissipation efficiency and air circulation efficiency of the upper-abdomen portion 23', thereby enabling timely evaporation and removal of the moisture and sweat between the user and the baby so that the user's and the baby's comfort is ensured.

What is claimed is:

1. A body-carried device with a heat dissipation system, comprising:

a receiving bag having a receiving space and a heat dissipation area, wherein the heat dissipation area is located between the receiving space and a person who is carrying the body-carried device on the person's body, and the heat dissipation area is provided with a vent hole;

two carrying straps corresponding to each other and provided on a backside of the receiving bag; and the heat dissipation system, which is provided in the heat dissipation area of the receiving bag and has a pump and an airflow guide tube unit, wherein the pump is configured for direct contact with the person, the pump has an output hole and an input hole, the airflow guide tube unit has an air outlet tube assembly and an air inlet tube assembly, the air outlet tube assembly has a main tube and a branch tube, the main tube has one end provided at and in communication with the output hole of the pump, the main tube has an opposite end extending through the vent hole of the heat dissipation area, the branch tube has one end stemming from the main tube, the branch tube has an opposite end provided with an air outlet hole, the air inlet tube assembly has an open tube, the open tube has one end provided at and in communication with the input hole of the pump, and the open tube has an opposite end provided with an air inlet hole, wherein the backside of the receiving bag is provided with an upper-back portion, a lower-back portion, and an airflow channel between the upper-back portion and the lower-back portion; the airflow channel is concavely formed with respect to the upper-back portion and the lower-back portion; the vent hole of the heat dissipation area is located in the upper-back portion; and the pump is located in the lower-back portion, and wherein the air outlet hole of the branch tube of the air outlet tube assembly and the air inlet hole of the open tube of the air inlet tube assembly are located in the upper-back portion of the receiving bag.

2. The body-carried device with the heat dissipation system as claimed in claim 1, further comprising a pouch, wherein the heat dissipation system is provided in the pouch, the pouch is composed essentially of a breathable pad and a lining, the breathable pad is detachably connected to the lining, the breathable pad is provided with the vent hole, and the main tube of the air outlet tube assembly extends through the vent hole to communicate with an external environment.

3. The body-carried device with the heat dissipation system as claimed in claim 2, wherein the breathable pad of the pouch is provided with an opening, and the pump is located in the opening and exposed from the breathable pad.

4. The body-carried device with the heat dissipation system as claimed in claim 2, further comprising a breathable cushioning element provided between the breathable pad and the lining of the pouch.

5. The body-carried device with the heat dissipation system as claimed in claim 1, wherein the airflow guide tube unit further has a first one-way valve and a second one-way valve, the first one-way valve is mounted in the main tube of the air outlet tube assembly, and the second one-way valve is mounted in the open tube of the air inlet tube assembly.

6. The body-carried device with the heat dissipation system as claimed in claim 1, wherein the airflow guide tube unit further has a filtration element mounted on the open tube of the air inlet tube assembly.

* * * * *